US006517075B1

(12) United States Patent
Yoon

(10) Patent No.: US 6,517,075 B1
(45) Date of Patent: Feb. 11, 2003

(54) DARTBOARD WITH MAGNETIC RUBBER SHEET

(75) Inventor: Bong-Seok Yoon, Kyonggi-Do (KR)

(73) Assignee: Magnet 4U Co., Ltd., Kyonggi-do (KR)

( * ) Notice: Subject to any disclaimer, the term of this patent is extended or adjusted under 35 U.S.C. 154(b) by 0 days.

(21) Appl. No.: 09/931,234

(22) Filed: Aug. 17, 2001

(51) Int. Cl.[7] ..... F41J 3/00
(52) U.S. Cl. ..... 273/348.3
(58) Field of Search ..... 273/348.3, 119 A, 273/126 A, 239; 473/FOR 209

(56) References Cited

U.S. PATENT DOCUMENTS 2,562,089 A * 7/1951 Fishlove ..... 273/348.3
2,645,491 A * 7/1953 Volman ..... 273/348.3
3,147,976 A * 9/1964 Millar ..... 273/348.3
3,170,693 A * 2/1965 Felsher ..... 273/348.3
3,508,752 A * 4/1970 Lemon ..... 273/348.3
5,005,841 A * 4/1991 Klick ..... 273/239
5,613,684 A * 3/1997 Gittens et al. ..... 273/348.3
5,967,520 A * 10/1999 Chen ..... 273/348.3

FOREIGN PATENT DOCUMENTS

CA 2037674 * 6/1992 ..... 473/FOR 209

* cited by examiner

*Primary Examiner*—Mark S. Graham
(74) *Attorney, Agent, or Firm*—Bacon & Thomas

(57) ABSTRACT

Disclosed herein is a dartboard with a magnetic rubber sheet. The dartboard includes a target board, a holding pole and two closure members. The target board includes a magnetic rubber sheet having a rectangular shape and containing iron, the two sheets of cotton flannel being attached to both surfaces of the magnetic rubber sheet and having raisings on their outer surfaces, and an upper fitted piece attached to the upper end of the front surface of one of said two sheets of flannel. The holding pole includes a hollow for holding one end of the target board, a slit formed along the entire length of the holding pole to pass through the inner and outer circumferential surfaces of the holding pole, and holes for allowing a hanging string to be fastened to the holding pole. The two closure members are each provided with an inserting recess into which one end of the holding pole is inserted.

4 Claims, 5 Drawing Sheets

DARTBOARD WITH MAGNETIC RUBBER SHEET

BACKGROUND OF THE INVENTION

1. Field of the Invention

The present invention relates generally to a magnetic dartboard, which is capable of being rolled, in the manner of cloth and paper and so is convenient to carry and keep, and more particularly to a dartboard with a magnetic rubber sheet, in which the rubber sheet is formed by mixing magnetic iron with rubber powder and vulcanizing the mixture to be magnetized, two sheets of cotton flannel having raisings are adhered to both surfaces of the rubber sheet, and a target is printed on one surface of the cotton flannel through a silk-screen process, thereby facilitating the carrying and keeping of the dartboard as well as reducing a noise produced when a magnetic dart is cast onto the dartboard.

2. Description of the Prior Art

A dart game is a western, indoor amusement in which darts are thrown several times at a target marked with concentric circles divided into segments and a bull's eye at its center, and in which a resulting score is calculated by adding up the point values of the portions hit by the darts so as to decide the game. Each of the darts is relatively short, and has a pointed tip.

Typically, a conventional dartboard onto which darts are thrown is made of wood, cork or compressed sawdust. Marked portions formed on the dartboard are adhered to or directly printed on the surface of the dartboard.

The conventional dartboard made of wood or the by-product of the wood has a problem in that it becomes unusable because many traces formed by the penetration of tips of the darts remain on the dartboard after dart games are played. This dartboard has another problem in that it is dangerous because it requires darts having metallic tips.

Therefore, in order to solve the above problems, there has been proposed another conventional dartboard, which is provided on its surface with many projections of synthetic resin and many depressions whose cross sectional shapes are rectangular and whose cross sectional areas are downwardly reduced as shown in FIG. 1.

Darts used for the second conventional dartboard made of the synthetic resin each have at its front end a pointed tip made of synthetic resin. A dart game is conducted by throwing the darts onto the second conventional dartboard, whereby the pointed tips of the darts are inserted into the depressions 11 formed between the projections made of synthetic resin and provided on the surface of the dartboard.

Since the second conventional dartboard and the second conventional darts are made of synthetic resin, the damage of the dartboard and the risk of injury can be eliminated. However, the conventional dartboard is provided with a plurality of projections and depressions, so it is difficult to fabricate the dartboard in comparison with a first conventional wooden dartboard and the fabricating costs of the dartboard is increased.

Therefore, there has been proposed a further conventional dartboard with darts which uses a steel plate and a magnet so as to prevent the dartboard from being damaged as well as reducing fabricating costs of the dartboard and being free from danger. The construction of the dartboard is as follows.

As shown in FIG. 2, the third conventional dartboard is formed as a laminated structure comprising a target board 21, a steel plate 22 and a rear paperboard 23. The steel plate 22 is adhered to the rear paperboard 23, and the target board 21 is adhered to the steel plate 22, such that the target board 21 forms the upper face of the dartboard. The front end of the dart 24 has a magnet.

In order to play the dart game, when the dart to which the magnet is attached is thrown onto the dartboard, the dart is adhered to the dartboard by magnetic attraction between the steel plate inserted into the dartboard and the magnet of the dart.

The third conventional dartboard into which the steel plate is inserted protects people in the playing area from getting hurt by the dart, is not damaged in spite of playing several dart games, and is easy to fabricate. However, it has a problem in that it makes a noise on throwing the dart onto the dartboard because the steel plate is inserted into the dartboard onto which the magnetic dart is thrown.

Therefore, the dartboard into which the steel plate is inserted is unsuitable for playing the game at a quiet place.

As described above, the conventional dartboards are difficult to carry and keep, because dartboards which are made of wood or synthetic resin or into which the steel plates are inserted are tablet-shaped and cannot be varied in form.

SUMMARY OF THE INVENTION

Accordingly, the present invention has been made keeping in mind the above problems occurring in the prior art, and an object of the present invention is to provide a dartboard with a magnetic dart, which is made of a rubber sheet to be flexible, thereby being convenient to carry and keep, preventing the surface of the dartboard from being damaged and reducing the impact noise of the dart on the dartboard.

In order to accomplish the above objects, the present invention provides a dartboard with a magnetic rubber sheet, comprising: a target board comprising a magnetic rubber sheet having a rectangular shape and containing iron, two sheets of cotton flannel having the same size as that of the magnetic rubber sheet, being attached to both surfaces of the magnetic rubber sheet and having raisings on their outer surfaces, and an upper fitted piece attached to the upper end of the front surface of one of said two sheets of flannel; a holding pole comprising, a hollow for holding one end of the target board, a slit formed along the entire length of the holding:pole to pass through the inner and outer circumferential surfaces of the holding pole so that the lower peripheral portion of the upper end of the target board just under the upper fitted piece is laterally inserted into the slit to hold the upper end of the target board in the hollow, and holes formed in the vicinity of both ends of the holding pole so as to fasten a hanging string to the holding pole and hang the dartboard on the wall; and two closure members each provided with an inserting recess into which one end of the holding pole is inserted.

BRIEF DESCRIPTION OF THE DRAWINGS

The above and other objects, features and other advantages of the present invention will be more clearly understood from the following detailed description taken in conjunction with the accompanying drawings, in which:

FIGS. 2*a* and 2*b* show a magnetic dart and a target board for magnetic darts in accordance with another prior art, wherein FIG. 2*a* is an exploded perspective view of this target board and FIG. 2*b* is a perspective view of this magnetic dart;

FIGS. 3*a* and 3*b* show a dartboard with a magnetic rubber sheet in accordance with an embodiment of the present invention, wherein FIG. 3*a* is a perspective view of the dartboard in an unrolled state and FIG. 3*b* is a perspective view of the dartboard in a rolled state;

DESCRIPTION OF THE PREFERRED EMBODIMENTS

The principal features of a dartboard in accordance with the present invention are a vulcanized rubber sheet containing iron and two sheets of flannel whose outer surfaces are provided with raisings.

A magnetic rubber sheet applied to the dartboard of the present invention is manufactured by mixing 80–90 wt % iron with 10–20 wt % rubber powder and vulcanizing the mixture to form a tablet-shaped palette. The tabular rubber sheet made in this way not only is flexible but also has magnetism, that is the property of being attracted by magnets, due to the iron. This rubber sheet is flexible, so the sheet can be rolled easily around a medium such as a pole, in the manner of cloth or paper. The rubber sheet is not hard, so it reduces a noise when the magnet of the dart impacts on the surface of the dartboard, in comparison with hard plates such as a steel plate.

In the case where the magnetic rubber sheet contains iron less than 80 wt %, the magnetic dart is not well adhered to the dartboard. On the other hand, in the case where the magnetic rubber sheet contains iron more than 90 wt %, its iron content is so high that the magnetic rubber sheet is easily broken.

The two sheets of cotton flannel are adhered to both surfaces of the magnetic rubber sheet and have raisings on their outer surfaces. The flannel constructed in this way present a good appearance in addition to reducing the noise when the magnetic dart impacts on the dartboard and preventing the surface of the magnetic rubber sheet from being damaged in spite of repeated impacts by the magnetic dart. Concentric circles and point values are printed on one surface of the flannel through a silk-screen process.

Figure 1:
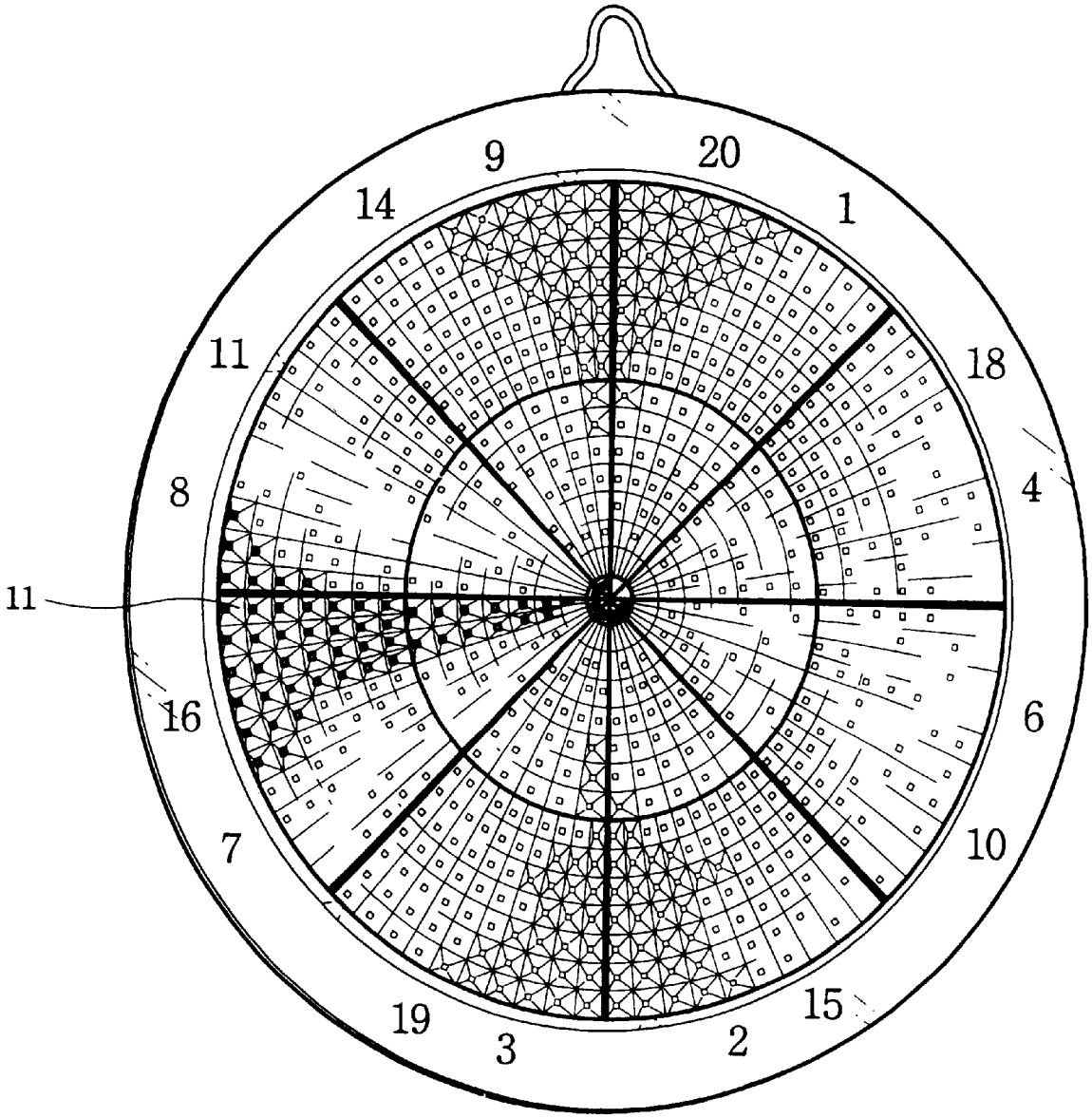
Fig. 1 (PRIOR ART)
FIG. 1 is a plan view showing a synthetic resin target board in accordance with a prior art, with a plurality of projections of the synthetic resin formed on one surface of the target board.
Figure 2A:
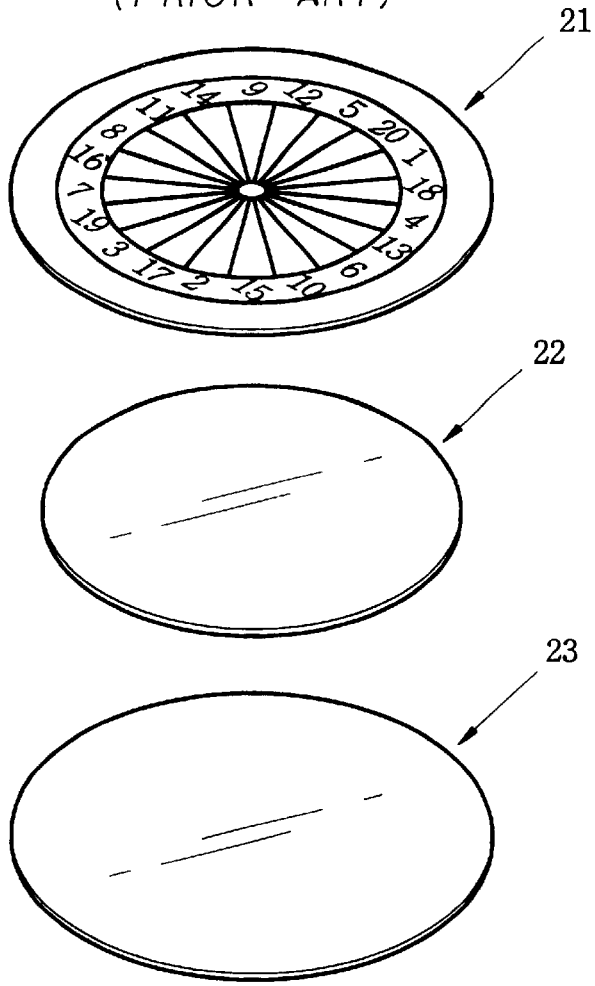
Fig. 2a (PRIOR ART)
Figure 2B:
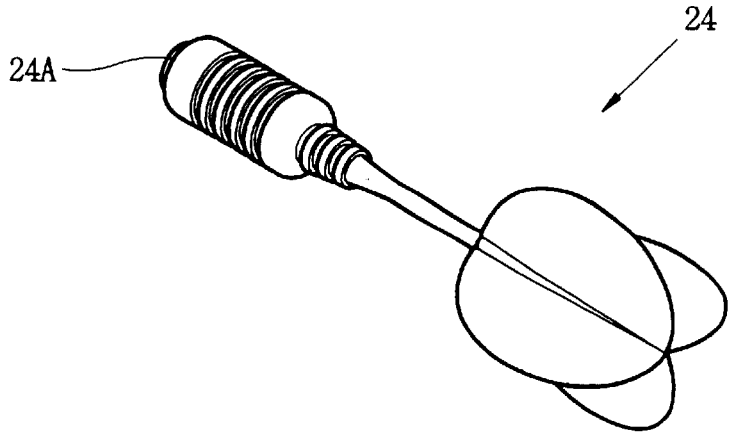
Fig. 2b (PRIOR ART)
Figure 3A:
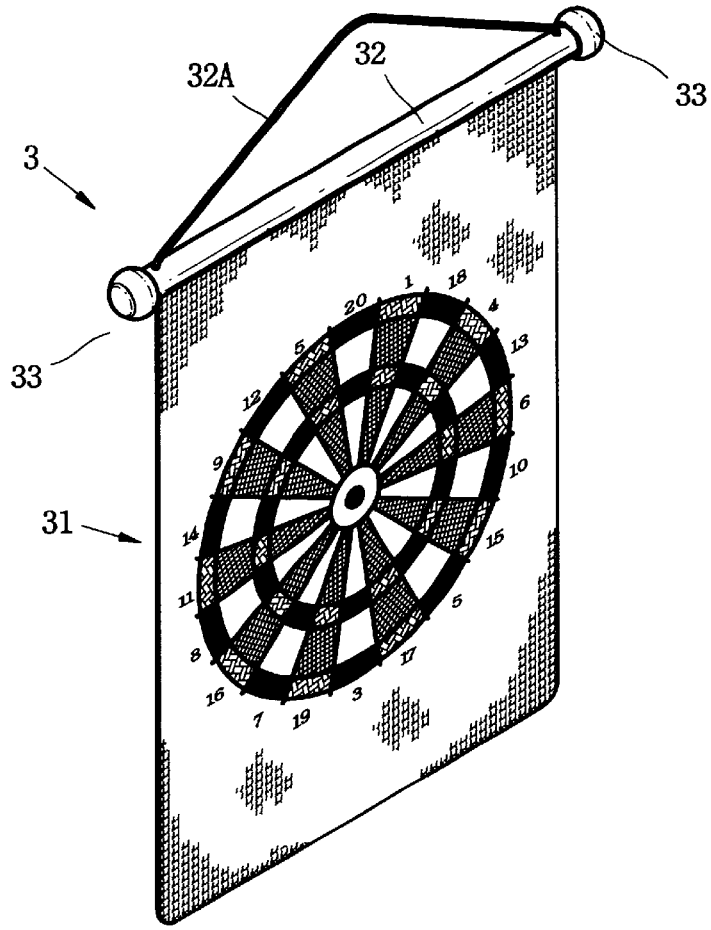
Figure 3B:
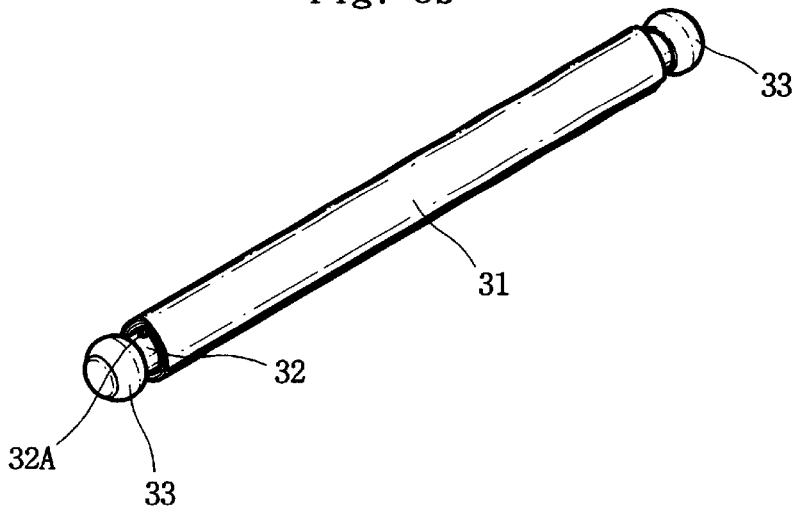
Figure 4:
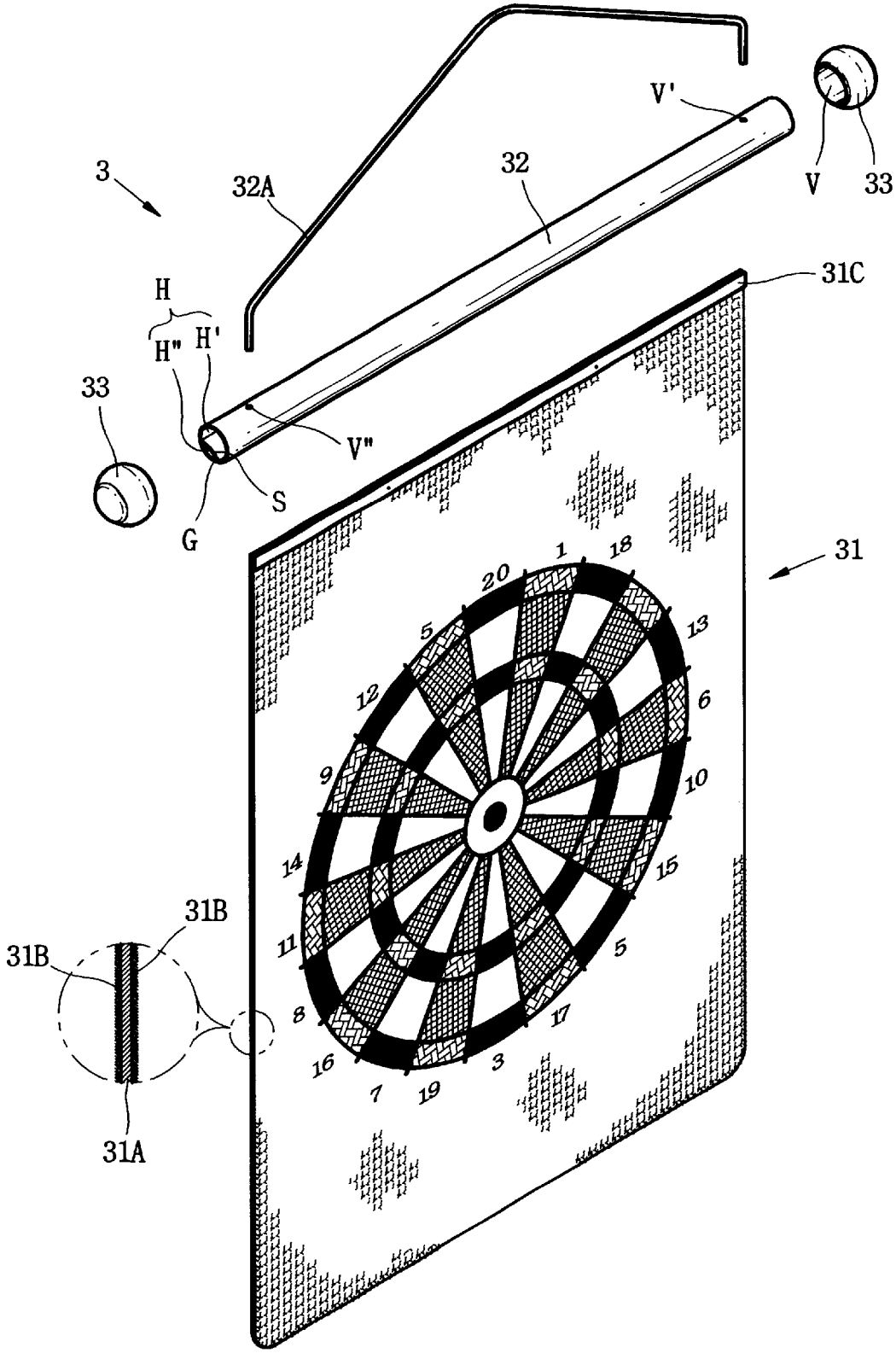
FIG. 4 is an exploded perspective view of the dartboard having the magnetic rubber sheet in accordance with the embodiment.
Figure 5:
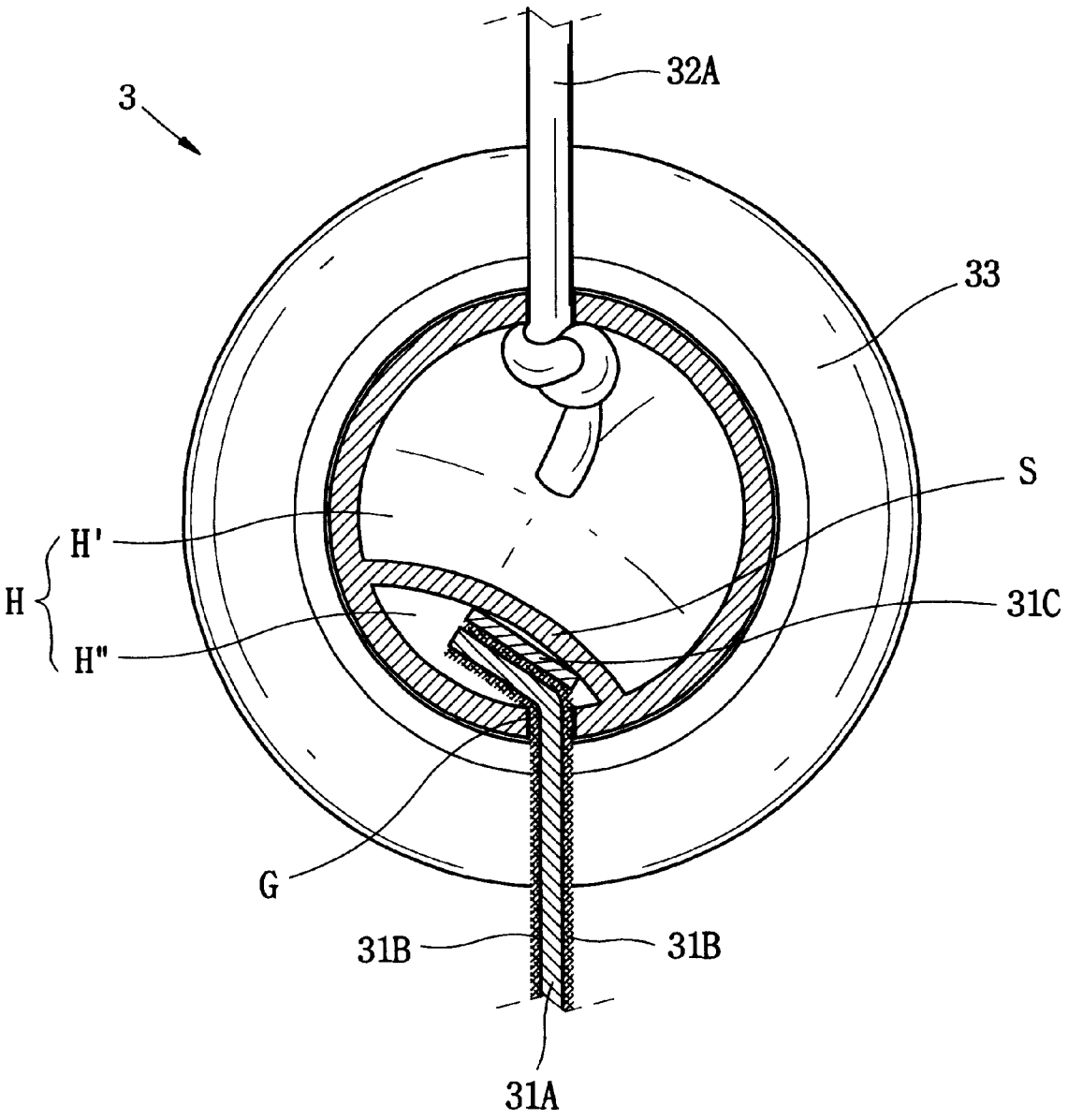
FIG. 5 is a detailed, partial sectional view showing the dartboard and its holding pole.

FIG. 3 shows the dartboard with the magnetic rubber sheet in accordance with an embodiment of the present invention. FIG. 4 is an exploded perspective view of the dartboard with the magnetic rubber sheet in accordance with the embodiment. FIG. 5 is a detailed, partial cross sectional view showing the dartboard and its holding pole.

The dartboard 3 of the present invention is mainly comprised of a target board 31, a holding pole 32 and two closure members 33.

As shown in the drawings, the target board 31 includes a magnetic rubber sheet 31A, which has a rectangular shape and a high iron content. Two sheets of cotton flannel 31B are attached to both surfaces of the magnetic rubber sheet 31A, are equal to the magnetic rubber sheet 31A in size, and have raisings on their outside surface. An upper fitted piece 31C is attached to an upper end of the front surface of one of the two sheets of flannel.

A hollow holding pole 32 includes a hollow H for holding one end of the target board 31 to which the upper fitted piece 31C is attached. A straight slit G is formed along the entire length of the holding pole 32 to pass through inner and outer circumferential surfaces of the holding pole 32 so that a lower peripheral portion of an upper end of the target board 31 just under the upper fitted piece 31C is laterally inserted into the slit G to hold the upper end of the target board 31 in the hollow H. Two fastening holes V' are formed in the vicinity of both ends of the holding pole 32 so as to fasten a hanging string 32A to the holding pole 32 and hang the dartboard 3 on the wall.

Two closure members 33 each is provided with an inserting recess V into which one end of the holding pole 32 is inserted.

It is preferable to use an adhesive for adhering two sheets of the cotton flannel 31B to both surfaces of the magnetic rubber sheet 31A. It is more preferable to use a double-sided adhesive paper for adhering two sheets of the cotton flannel 31B to both surfaces of the magnetic rubber sheet 31A in terms of productivity. A target is printed through a silk-screen process on the outer surface of the cotton flannel 31B adhered to one surface of the magnetic rubber sheet 31A. Various patterns other than the target are able to be printed on the outer surface of the cotton flannel 31B adhered to another surface of the magnetic rubber sheet 31A through a silk-screen process and thus the dartboard 3 of the present invention can be used as a decorative item unless the dart game is played.

The hollow H of the holding pole 32 is divided into the small hollow portion H" and the large hollow portion H' by means of the inner partition S. The slit G into which the target board 31 is fitted passes through inner and outer circumferential surfaces of the holding pole 32.

The reason why the hollow H of the holding pole 32 is divided into the small hollow portion H" and the large hollow portion H' by means of the inner partition S is to increase the strength of the holding pole 32. Moreover, the maximum height of the small hollow portion H" can be adjusted to have a length shorter than the width of the upper fitted piece 31C by means of the inner partition S, so one end of the target board 31 including the upper fitted piece 31C held in the small hollow portion H" can be bent with regard to the non-inserted portion of the target board 31. Consequently, one end of the target board 31 including the upper fitted piece 31C held in the small hollow portion H" is not slipped out of the holding pole 32 because one end of the target board 31 including the upper fitted piece 31C held in the small hollow portion H" is securely fitted into the inside of the slit G.

As described above, the present invention provides the dartboard with the magnetic rubber sheet, which is comprised of the magnetic rubber sheet and two sheets of cotton flannel so that the dartboard is easily rolled around the holding pole and does not occupy too much space, thereby facilitating the carrying and keeping of the dartboard.

The present invention provides the dartboard with the magnetic rubber sheet, in which two sheets of the cotton flannel having raisings on their surface are adhered to the soft magnetic rubber sheet, thereby reducing the impact noise of the dart on the dartboard and being usable at a quiet place. The present invention provides the dartboard with the magnetic rubber sheet, in which other patterns as well as the target can be printed on the surface of the cotton flannel through a silk-screen process, thereby being used as a decorative item.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A dartboard with a magnetic rubber sheet, comprising:

a target board comprising, a magnetic rubber sheet having a rectangular shape and containing iron, and having a first surface and a second surface;

two sheets of cotton flannel having the same size as that of the magnetic rubber sheet, each flannel sheet having a front and back surface and a first edge and a second distal edge, a first said sheet of cotton flannel is attached to the first surface of the magnet sheet and the second sheet of cotton flannel is attached to said second surface of the magnetic rubber sheet, and a fitted piece is attached to the first edge of the front surface of one of said two sheets of flannel;

a holding pole, comprising, a hollow pole for holding one end of the target board, a slit formed along an entire length of the hollow pole and passing through inner and outer circumferential surfaces of the hollow pole so that a lower peripheral portion of an upper end of the target board just under the upper fitted piece extends laterally into the slit to hold the upper end of the target board in the hollow pole, and holes formed in the vicinity of both ends of the hollow pole so as to fasten a hanging string to the holding pole; and two closure members each provided with an inserting recess into which one end of the hollow pole is inserted.

2. The dartboard with the magnetic rubber sheet according to claim 1, wherein said magnetic rubber sheet consists of 80–90 wt % iron and 10–20 wt % rubber.

3. The dartboard with the magnetic rubber sheet according to claim 1, wherein said hollow pole is divided into a small hollow portion and a large hollow portion by an inner partition.

4. The dartboard with the magnetic rubber sheet according to claim 3, wherein said slit is formed through a portion of the holding pole around the small hollow portion.

* * * * *